United States Patent [19]

Markofsky

[11] 4,210,489

[45] Jul. 1, 1980

[54] METHOD OF IMPARTING WET STRENGTH TO PAPER PRODUCTS

[75] Inventor: Sheldon B. Markofsky, Olney, Md.

[73] Assignee: W. R. Grace & Co., New York, N.Y.

[21] Appl. No.: 917,716

[22] Filed: Jun. 21, 1978

[51] Int. Cl.[2] ..... D21D 3/00

[52] U.S. Cl. ..... 162/164 R; 162/164 EP; 162/168 R; 162/168 N

[58] Field of Search ..... 162/168 N, 168 R, 169, 162/164 EP, 164 R; 260/29.6 NR, 874, 897 R, 17.4 CL; 427/391

[56] References Cited

U.S. PATENT DOCUMENTS

| | | | |
|---|---|---|---|
| 2,723,195 | 11/1955 | Blake | 162/168 R |
| 3,248,353 | 4/1966 | Coscia | 162/164 EP |
| 3,291,679 | 12/1966 | O'Brien | 162/164 EP |

FOREIGN PATENT DOCUMENTS

| | | | |
|---|---|---|---|
| 2502084 | 8/1975 | Fed. Rep. of Germany | 162/168 N |
| 50-5285 | 3/1975 | Japan | 162/168 R |

*Primary Examiner*—S. Leon Bashore
*Assistant Examiner*—Peter Chin
*Attorney, Agent, or Firm*—Howard J. Troffkin; William W. McDowell, Jr.

[57] ABSTRACT

The present invention relates to a method of forming paper webs having high wet strength and water absorbency by impregnating cellulose fibrous material with an aqueous composition made from a mixture of copolymers comprising an effective amount of (A) a hydrolyzed product of a copolymer having the general formula:

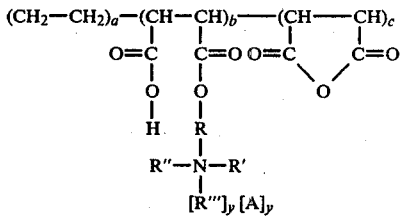

wherein R, R', R'', and R''' are each of $C_1$-$C_4$ alkyl group; A is a quarternary ammonium anion; y has a value of 0 to 1; and a is an integer and b and c are each integers including zero such that the ratio of a to b plus c is from about 2:1 to 1:2 and (B) a reaction product of a secondary alkylamine with a primary amine and with an epihalohydrin.

10 Claims, No Drawings

METHOD OF IMPARTING WET STRENGTH TO PAPER PRODUCTS

BACKGROUND OF THE INVENTION

The present invention relates to the formation of paper products from cellulosic fibers which have been treated with an aqueous composition containing (1) a hydrolyzed product of copolymers of ethylene/maleic anhydride or the half ester of ethylene/maleic anhydride and a tertiary or quarternary amino alkanol and (2) the reaction product of a secondary amine, a primary amine and an epihalohydrin. The resultant paper products exhibit a high degree of the combined properties of wet strength and water absorbency.

It is well known when resinous materials are added to paper and other cellulosic fibrous web products they tend to impart or improve certain desired properties. The type of resin which is added depends on the particular property desired in the final product. For example, it is desirable to impart the property of wet strength when the paper product is intended for use as tissues, towelling and other similar applications.

Resins previously found useful as wet strength agents include those disclosed in U.S. Pat. Nos. 3,607,622; 3,728,214 and 3,778,215. Such resins are the reaction product of certain polyamines and aminopolyamides with an acrylamide and then with a polyaldehyde. U.S. Pat. No. 3,556,932 teaches that resins formed by reacting gloxal with certain vinylamide polymers, such as ionic copolymers of acrylamide, are suitable materials for imparting wet strength to paper products. Similarly, U.S. Pat. No. 4,035,229 teaches that glyoxal modified poly (-alanine) resins are wet strength agents. These resins have the disadvantage of having relatively short shelf life.

Various resinous maleic anhydride compositions have been used in conjunction with paper products. For example, U.S. Pat. No. 3,261,798 to Farley discloses the paper products coated with a composition comprising an amine salt of a low molecular weight $C_6$–$C_{24}$ olefin/-maleic anhydride copolymer in combination with a bisulfite. Such paper products exhibit release properties.

U.S. Pat. Nos. 3,562,102; 3,468,823 and 3,382,142 disclose that various amine salts of half esters of maleic anhydride/alpha-olefin copolymers are useful paper sizing or water holdout agents. Similarly, U.S. Pat. No. 2,723,195 discloses paper products impregnated with a sizing and wet strength agent of a reaction product of an alkyl tertiary amino alcohol and a copolymer of maleic anhydride/styrene or derivatives thereof. Paper products containing these sizing agents lack water absorbency properties required of products to be used as tissues, towelling and the like. It is desired that such products be formed from paper which exhibits the combined properties of high degree of wet strength and water absorbency.

As used herein, the term "paper" includes sheet-like masses, webs and the like products made from fibrous cellulosic materials which may be derived from both natural and synthetic sources. Also included are masses, webs and the like products prepared from a combination of cellulosic and non-cellulosic materials such as synthetic materials as, for example, polyamide, polyester or polyacrylic fibers.

SUMMARY OF THE INVENTION

It has been unexpectedly found that paper products having the desired combined properties of good water absorbency and wet strength can be produced by treating the cellulosic fibers of the paper product with a composition comprising the combination of (A) a hydrolyzed product of a copolymer of ethylene/maleic anhydride or certain amino alcohol esters thereof and (B) a reaction product formed from a secondary amine, a primary amine and an epihalohydrin or a dihalo monohydroxy $C_3$–$C_4$ n-alkane.

The resultant product exhibits exceptionally high wet strength and water absorbency properties which causes the product to be useful as towelling and the like.

DETAILED DESCRIPTION OF THE INVENTION

The present invention is directed to a process for forming water absorbent, wet strength paper products, and to the product resulting therefrom, by impregnating the paper with an effective amount of a combination of a hydrolyzed ethylene/maleic anhydride or certain derivatives thereof as described herein below in combination with a reaction product formed from the combination of a secondary amine, a primary amine and an epihalohydrin as also described herein below.

The maleic anhydride copolymers found useful in the present invention are copolymers of ethylene/maleic anhydride or esters formed from a tertiary or quarternary amino alkyl alcohol with the copolymer.

The ethylene/maleic anhydride copolymers can be formed by any conventional mass, solvent or solvent/-non-solvent technique. For example, the copolymer can be formed by charging ethylene and the anhydride into a sealed reaction vessel and heating the monomeric mixture normally to a temperature ranging from about 40° to 80° C. for a period of time such that the major portion of monomers have polymerized. The temperature is then raised to from about 100° to 175° C. to cause substantial completion of the polymerization of the remaining monomer.

An alternate suitable method of forming the ethylene/maleic anhydride copolymers employed in the present invention is the conventional solvent/non-solvent method wherein the monomers are introduced into a liquid media which is a solvent for the monomers but a non-solvent for the polymer product. Such liquids are normally hydrocarbons such as benzene or xylene.

The polymerization is normally done with the aid of a free-radical catalyst such as azobis (isobutyronitrile), di-t-butyl peroxide, t-butyl perbenzoate, benzoyl peroxide and any initiator which is effective at temperatures of from about 50° to 150° C., such as isopropyl peroxydicarbonate, tetrachlorobenzoyl peroxide and the like. Each of the monomers is charged in amounts such that the resultant polymer has a molar ratio of ethylene to maleic anhydride monomeric units of from about 2:1 to 1:2 and preferably about 1:1.

When the preferred amino alcohol ester of ethylene/-maleic anhydride is desired, the ester can be formed by reacting the copolymer with amino alcohol in an inert, substantially anhydrous organic liquid at temperatures ranging from about −40° C. to about 150° C. with temperatures of from about 20° to 150° C. being most suitable. It is preferable that the liquid be a solvent for at least one of the reactants. The ester product, whether or not having complete esterification of the ethylene/anhydride copolymer will be discussed herein as a copolymer.

The amino alcohol can be a tertiary amine having alkyl or alkoxyalkyl groups or mixtures thereof bonded to the amino nitrogen. Further, the tertiary amine contains a single hydroxyl group pendant from one of the alkyl or alkoxyalkyl groups and the amine compound is void of other active groups. Each alkyl or alkoxy group can contain from 1 to 4 carbon atoms. Preferably the amine alcohol compound should contain from 3 to 12 carbon atoms. Examples of such compounds are dimethyl amino methanol, dimethyl amino ethanol, diethyl amino propanol, dimethyl amino propanol, di-n-butyl amino propanol, diethyl amino ethanol, diethyl amino butanol and the like. Other monohydroxy tertiary amines such as dimethyl amino cyclohexanol are useful. Of these tertiary amines, diethyl amino ethanol and dimethyl amino ethanol are preferred.

Further, amino alcohols useful in forming ethylene/maleic anhydride ester derivatives useful in the present invention can be quarternary amino alcohols. Such quarternary amine alcohols can be formed by reacting one of the tertiary amine alcohols described herein above with a $C_1$–$C_4$ alkyl halide, such as methyl chloride, in known manners such that the alkyl group becomes bonded to the amine nitrogen and the halide becomes the quarternary ammonium anion. Such compounds can be reacted with the copolymer in the same manner as described above for forming esters from tertiary amine alcohols. Alternately, previously formed amino alcohol esters of the copolymer can be quarternized by reacting the $C_1$–$C_4$ alkyl halide in conventional manners with the copolymer ester of a dialkyl amino alcohol.

The amount of amino alcohol described hereinabove which can be used to cause the opening of the anhydride ring of the copolymer and the formation of the ester therewith may vary from about 0.1 to 1 mole of amino alcohol per mole of anhydride. Copolymer products formed from at least about 0.25 to 1 mole of amino alcohol per mole of anhydride are preferred. The resultant product can have a MW of from about 5,000 to 250,000 and preferably from about 50,000 to 100,000 and can be represented by the general formula:

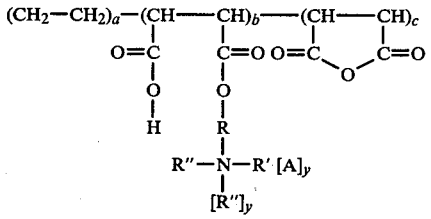

wherein R, R′, R″ and R‴ each represent a $C_1$ to $C_4$ alkyl or alkoxy group, A represents a quarternary ammonium anion such as a halide, y represents either 0 or 1 and a is an integer and b and c are each integers including zero such that the ratio a to b plus c is from about 2:1 to 1:2. Aqueous solutions contain the subject copolymer as a hydrolysis product as is well known such that the acid anhydride is at least partially in a hydrolyzed form. The aqueous solution should have a pH above about 7 and may contain a base, such as potassium hydroxide, ammonium hydroxide and the like to aid in forming a soluble hydrolyzed product.

It has been observed that when the above subject copolymer, is applied as the sole agent to cellulosic fibers to be used in forming paper products, the resultant products do not have the desired combined properties of wet strength and water absorbency.

It has been unexpectedly found that the above described ethylene/maleic anhydride copolymers when used in combination with the terpolymer described herein below gives synergistic combined properties of increased wet strength and water absorption which are highly desired to produce paper towelling products and the like of high quality.

The subject terpolymers found useful in the present invention are described in U.S. Pat. No. 3,855,299 to Witt, said teaching is incorporated herein by reference. As described in the referenced patent, the subject terpolymer is a reaction product formed from an epihalohydrin, a major amount of a secondary alkylamine having 2 to 12 carbon atoms and at least one secondary amino group per molecule, and a minor amount of a primary alkylamine having 1 to 25 carbon atoms and at least one primary amino group per molecule. The reaction product is prepared by admixing the primary alkylamine and the secondary alkylamine in an aqueous medium and adding the epihalohydrin thereto while maintaining the temperature of the resulting reacting mixture at 25°–125° C. until the viscosity of the reacting mixture reaches a predetermined value of generally 20–20,000 centipoises. If desired, acid can be added when the predetermined viscosity has been reached to lower the pH and to terminate the reaction. The equivalent ratio of epihalohydrin to primary amine is 1:0.009 to 1:0.5 and epihalohydrin to the combination of primary plus secondary amine is 1:0.22 to 1:1.3. Further, as described in the referenced teaching, suitable reaction products can be formed by substitution of all or part of the monomeric reactants with certain equivalent compounds on an equivalent basis.

The combination of copolymer and terpolymer are water soluble and are readily applied as an aqueous composition. The pH of the composition should preferably be from about 4 to 9. In addition, other conventional agents normally used in paper making processes can be used in conjunction with the presently described combination of agents.

The above-described combination of copolymer and terpolymer agents can be readily applied to cellulosic fibers prior to their formation into a web or sheet configuration, such as by incorporation of the combined agents as part of a conventional head box liquor. Alternately, the combination of agents of the subject invention can be applied to cellulosic fibers subsequent to their formation into a web or sheet configuration by conventional application means such as by utilization of a size press, by spraying or by tub soaking. The aqueous composition containing the combined agents of the subject invention should be contacted with the cellulosic fibers for an amount of time and in a concentration to cause the resultant dry paper product to have from about 0.1 to 5 percent of the combined agent therein. The weight ratio of the above-described epihalohydrin terpolymer to ethylene/maleic anhydride copolymer should be from about 0.2:1 to 50:1 and preferably from about 0.5:1 to 10:1.

The treated cellulosic fiber web should be subjected to a temperature of from 90° to 150° C. for a period of time of from about 5 minutes to about 3 hours and preferably from about 10 to 60 minutes to cause drying of the paper product and curing of the agents therein.

The following examples are given for illustrative purposes only and are not meant to be a limitation of the invention described herein except as defined by the claims appended hereto. All parts and percentages are by weight unless otherwise indicated.

EXAMPLE I

Preparation of Dimethylaminoethyl ester of ethylene/maleic anhydride copolymer A flask equipped with a stirrer and calcium chloride drying tube was charged with 350 parts of dry acetone and 25 parts of commercially available ethylene-maleic anhydride copolymer having an average molecular weight of 70,000 and a monomer molar ratio of about 1:1. The charged materials were stirred until a solution was obtained. The flask was then cooled to a point where the polymer was about to precipitate out. A cold solution of 10.6 parts dimethylaminoethanol in 40 parts dry acetone was added to the flask with stirring and the mixture was allowed to warm to room temperature. Stirring was continued for 30 additional minutes. The precipitate was filtered under vacuum and dried. The yield of ester product was substantially quantitative and labeled Copolymer A (0.63 moles ester/mole anhydride).

In the same manner as above, several samples of aminoalcohol esters of ethylene/maleic anhydride were formed using varying molar ratios of alcohol to anhydride of the polymer. The resultant products were formed in substantially quantitative amounts.

EXAMPLE II

Preparation of Quarternary Ammonium Ester of Ethylene/maleic anhydride copolymer 25.2 parts (0.2 moles repeating unit) of a commercially available copolymer of ethylene/maleic anhydride having an average molecular weight of 70,000 and a monomer molar ratio of about 1:1 was dissolved in 300 parts of hot water. The solution was cooled to room temperature. 3.5 parts of (2-hydroxy ethyl)trimethyl ammonium chloride was added to the polymer solution with stirring. The solution was allowed to evaporate to dryness at 150° C. over a period of about 20 hours. A yellowish, powdery product was obtained in substantially quantitative amounts having 0.125 mole ester per mole anhydride and was labeled Copolymer B.

In the same manner as above an ester product was formed except that 10.5 parts (2-hydroxyethyl) trimethylammonium chloride was used to form a copolymer product having a molar ratio of ester to anhydride of 0.375 and was labeled Copolymer B'.

EXAMPLE III

Preparation of Terpolymer Product

A 10.2 gram (0.1 mole of 0.2 equivalents) portion of dimethylaminopropylamine and a 112.5 g portion of an aqueous 40% dimethylamine solution (1 mole, i.e., 1 equivalent of dimethylamine) were admixed in a 500 ml glass reaction zone provided with a thermometer, a condenser, and an addition funnel. The mixture in the reaction zone was cooled to 25°-30° C. and 102 g (1.1 mole or 2.2 equivalents) of epichlorohydrin was added to the reaction zone over a period of about 10-15 minutes while stirring the mixture in the reaction zone and while maintaining said mixture within a temperature range of 30°-35° C. by cooling said mixture. Cooling was necessary because the reaction between the epichlorohydrin and the amines was exothermic. After all of the epichlorohydrin had been added the exotherm subsided. The material in the reaction zone was heated to 60°-65° C. and maintained within this temperature range while stirring and adding 300 ml of water thereto at a rate of 65 ml per hour. After all of the water had been added the resulting mixture was stirred for another 2 hours while maintaining the temperature at 60°-65° C. The resulting mixture was then cooled to 25° C. and a first sample was taken for testing. The pH of the sample was found to be 6.3 and its viscosity was found to be 75 centiposes. Said sample had a solid content of 31.4%.

After standing for 3 days at room temperature (ca. 22°-28° C.) the viscosity of the resulting mixture had increased to 150. Accordingly, dilute (6 normal) sulfuric acid solution was added thereto to bring the pH to 3.2 to terminate further reaction and stabilize the product. The terpolymer product was labeled Terpolymer A.

EXAMPLE IV

Hand sheet samples were formed from a master batch of pulp furnish formed by beating 50% hardwood/50 softwood pulp to a 45 second Williams slowness at a 1.57% consistency in a conventional pulping apparatus. Each 5 gallon container of pulp was preserved with 2 ml of 37% formaldehyde and stored at 32° F. Before use each 1300 ml of pulp slurry was diluted with 7700 ml of water.

The polymer solutions indicated in Table I below were added to 900 ml portions of the diluted pulp furnish under constant agitation. The treated furnish was formed into hand sheet by conventional techniques using a Valley Iron Work's hand sheet mold. Each hand sheet was placed between two pieces of pulp test blotting paper (Howard Paper Mills, Inc.) with the felt side facing the test sheet. A drying disk was placed over the sandwiched handsheet and then the handsheet was pressed by passing a 22 pound brass roller over the drying disk 8 times. The blotting paper is removed and replaced with new blotting paper. The sample is then subjected to 50 psi pressure for 5 minutes. The resultant sample is again removed from the blotting paper and cured at 128° C. for 20 minutes. Duplicate hand sheet samples were each tested for wet strength by submerging in diionized water for one minute and then tested in accordance with ASTM-D-829 at 23° C. and 50+2 percent R.H. The results are shown in Table I below.

Table I

| Parts of 0.1% aq. sol. of Copolymer A* | Parts of 0.1% aq. sol. of Terpolymer A | | Wet Strength (lbs.) | Dry Strength (lbs.) |
|---|---|---|---|---|
| 5 | 6 | | 2.23 | 17.5 |
| 4 | 6 | | 3.60 | 25.0 |
| 3 | 6 | | 2.61 | 23.7 |
| 2 | 6 | | 2.65 | 22.5 |
| 1 | 6 | | 2.10 | 26.1 |
| 0** | 0 | approx. | 0.5 | |

*(0.625 mole ester/mole anhyd.)
**Control

Each of the hand sheet samples was treated with set quantity of water and was observed to exhibit good water absorbancy.

EXAMPLE V

Hand sheet samples were formed and tested in the same manner as described in Example IV above except that the solutions were at 0.5 percent concentrations and the indicated amount of Terpolymer A was first added to the formed furnish followed by the immediate addition of Copolymer A. The results are given in Table II below.

Table II

| Parts of 0.5% aq. sol. of Copolymer A | Parts of 0.5% aq. sol. of Terpolymer A | Wet Strength (lbs.) | Dry Strength (lbs.) |
|---|---|---|---|
| 5 | 1 | 3.2 | 15.5 |
| 5 | 5 | 5.8 | 24 |
| 5 | 10 | 4.5 | 18.5 |
| 5 | 15 | 2.7 | 16.4 |
| 5 | 20 | 2.5 | 19.7 |
| 5 | 25 | 2.6 | 19.8 |

The hand sheets were observed to exhibit good water absorbancy.

EXAMPLE VI

Hand sheet samples were formed and tested in the same manner as described in Example IV above except that the indicated amounts of Terpolymer A and Copolymer A were added to 900 parts of water and premixed together prior to introduction into the furnish. The resultant handsheets were tested and the results are given in Table III below.

Table III

| Parts of 0.5% aq. sol. of Copolymer A | Parts of 0.5% aq. sol. of Terpolymer A | Wet Strength (lbs.) | Dry Strength (lbs.) |
|---|---|---|---|
| 5 | 3 | 3.2 | 17.2 |
| 5 | 5 | 5.0 | 19.8 |
| 5 | 7 | 5.3 | 23.6 |
| 5 | 9 | 4.6 | 24.5 |

The hand sheets were observed to have good water absorption properties.

EXAMPLE VII

In the same manner as described in Example IV above handsheet samples were formed and tested except that the Copolymer A was substituted with copolymers having varying molar percentages of ester per mole of anhydride. The results are given in Table IV below.

Table IV

| Parts 0.1% aq. sol. of Copolymer | Mole ester/ anhyd. in Copolymer | Parts of 0.5% aq. sol. Terpolymer A | Wet Strength (lbs.) | Dry Strength (lbs.) |
|---|---|---|---|---|
| 4 | 0.125 | 2 | 1.5 | 21 |
| 7 | 0.125 | 3 | 2.2 | 24 |
| 4 | 0.20 | 2 | 2.1 | 17.5 |
| 5* | 0.125 | 0 | 0.09 | |
| 12** | 0.125 | 0 | 0.11 | |
| 5*** | 0.375 | 0 | 0.6 | |

*Comparative-cured at 105° C. for 15 min.
**Comparative-cured at 105° C. for 60 min.
***Comparative-cured at 150° C. for 60 min.

EXAMPLE VIII

Hand sheet samples were formed and tested in the same manner as described in Example IV above except that Copolymer B' described in Example II above was used in place of Copolymer A. In addition, for comparative purposes, samples were formed in the same manner except that no copolymer was added to the furnish. The results are given in Table V below:

Table V

| Parts 0.1% aq. sol. of Copolymer B' | Parts 1% aq. sol. of Terpolymer A | Wet Strength (lbs) |
|---|---|---|
| 8 | 2 | 3.8 |
| 2 | 2 | 1.9 |
| 0 | 2 | 0.5 |
| 0 | 4 | 0.5 |

The hand sheets treated with the combination of copolymer and terpolymer exhibited good wet strength and water absorbancy.

EXAMPLE IX

Handsheet samples were formed and tested in the same manner as described in Example IV above except that Copolymer A was substituted with commercially available ethylene/maleic anhydride copolymer having an average molecular weight of about 70,000 and a monomer ratio of 1:1. The results are given in Table VI below:

Table VI

| Parts 0.1% aq. sol. of Copolymer | Parts 0.5% aq. sol. of Terpolymer A | Wet Strength (lbs) |
|---|---|---|
| 2 | 2 | 1.03 |
| 5 | 4 | 1.53 |
| 8 | 6 | 2.06 |

Each of the hand sheets was observed to exhibit good water absorbancy.

While the invention has been described in connection with certain preferred embodiments, it is not intended to limit the invention to the particular forms set forth, but, on the contrary, it is intended to cover such alternatives, modifications and equivalents as defined by the appended claims.

It is claimed:

1. A method of imparting a combination of wet strength and water absorbency to paper formed from cellulosic fibers comprising contacting the cellulosic fibers with an aqueous solution of a composition comprising an effective amount to impart wet strength and water absorbency of (1) a copolymer selected from an at least partially hydrolyzed ethylene/maleic anhydride or an ethylene/maleic anhydride half ester, having the general formula:

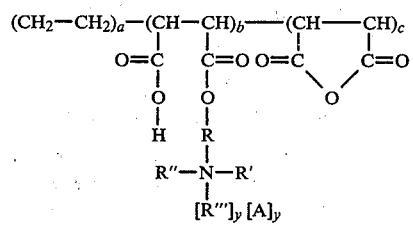

wherein R, R', R'', and R''' are each of $C_1$–$C_4$ alkyl or alkoxy groups; A is a quarternary anion; Y has a value of 0 to 1 and a is an integer, and b and c are integers including 0, such that the ratio of a to b plus c is 2:1 to 1:2, and (2) a reaction product formed by reacting an aqueous mixture of reactants (a) a $C_2$–$C_{12}$ secondary alkyl amine; (b) a $C_1$–$C_{25}$ primary amine and (c) a member selected from epihalohydrin or a dihalo monohydroxy $C_3$–$C_4$ alkane; the equivalent ratio of reactant (c)

to (b) is 1:0.009 to 0.5, and of reactants (c) to (b) plus (a) is 1:0.22 to 1.3, and the weight ratio of reaction product (2) to copolymer (1) being from about 0.2:1 to 50:1 and treating the paper formed from said cellulosic fibers to sufficient elevated temperature to cause drying of the paper product and curing of the agents therein.

2. The method according to claim 1 wherein the cellulosic fiber is contacted with the aqueous wet strength composition prior to the formation of a web therefrom and the treated web is subjected to a temperature of from about 90° to 150° C.

3. The method according to claim 1 wherein the cellulosic fiber is contacted with the aqueous wet strength composition subsequent to the formation of the web therefrom and the treated web is subjected to a temperature of from about 90° to 150° C.

4. The method according to claim 2 or 3 wherein the ratio of b to c in copolymer (1) is from about 0.1:1 to 1:1.

5. The method according to claim 2 or 3 wherein the ratio of b to c in copolymer (1) is at least about 0.25:1.

6. The method according to claim 1 wherein copolymer (1) has an average molecular weight ranging from about 5,000 to 250,000.

7. The method according to claim 6 wherein the copolymer (1) has an average molecular weight ranging from about 50,000 to 100,000.

8. A paper product capable of exhibiting high wet strength and water absorbency having impregnated therein from about 0.1 to 5 percent by weight of the dry paper of the composition comprising (1) a copolymer selected from an at least partially hydrolyzed ethylene/maleic anhydride or an ethylene/maleic anhydride half ester, having the general formula:

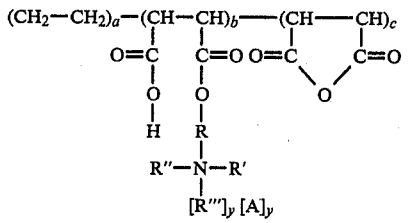

wherein R, R′, R″, and R‴ are each of $C_1$–$C_4$ alkyl or alkoxy groups; A is a quarternary anion; Y has a value of 0 to 1; and a is an integer, and b and c are integers including 0, such that the ratio of a to b plus c is 2:1 to 1:2, and (2) a reaction product formed by reacting an aqueous mixture of reactants (a) a $C_2$–$C_{12}$ secondary alkyl amine; (b) a primary amine and (c) a member selected from epihalohydrin or a dihalo monohydroxy $C_3$–$C_4$ alkane; the equivalent ratio of reactant (c) to (b) is 1:0.009 to 0.5 and of reactants (c) to (b) plus (a) is 1:0.22 to 1.3, and the weight ratio of reaction product (2) to copolymer (1) being from about 0.2:1 to 50:1.

9. The paper product of claim 8 wherein the ratio of b to c in copolymer (1) is from about 0.1:1 to 1:1.

10. The composition of claim 9 wherein copolymer (1) has an average molecular weight ranging from about 5,000 to 250,000 and reaction product (2) is formed from a ratio from reactants (a) to (b) of at least 1:1.

* * * * *

UNITED STATES PATENT AND TRADEMARK OFFICE

CERTIFICATE OF CORRECTION

PATENT NO. : 4,210,489

DATED : July 1, 1980

INVENTOR(S) : Sheldon B. Markofsky

It is certified that error appears in the above-identified patent and that said Letters Patent are hereby corrected as shown below:

In Column 8, line 61, change "Y" to --y--.

In Column 10, line 15, change "Y" to --y--.

In Column 10, line 28, change "The composition of Claim 9" to --The paper product of Claim 8--.

Signed and Sealed this

*Second* Day of *September 1980*

[SEAL]

*Attest:*

SIDNEY A. DIAMOND

*Attesting Officer*

*Commissioner of Patents and Trademarks*